United States Patent [19]

Hynes

[11] 4,197,669

[45] Apr. 15, 1980

[54] CONSTRUCTION ELEMENTS AND ASSEMBLED STRUCTURES

[76] Inventor: Bernard D. Hynes, 1425 S. Milwaukee St., Denver, Colo. 80210

[21] Appl. No.: 820,802

[22] Filed: Aug. 1, 1977

[51] Int. Cl.[2] ..... A63H 33/08

[52] U.S. Cl. ..... 46/25; 46/24; 35/72; 52/608

[58] Field of Search ..... 46/25, 24, 28, 30, 23, 46/27; 273/157 R; 35/72, 73, 69; D34/15 FF, 15 GG; 52/271, 593, 608

[56] References Cited

U.S. PATENT DOCUMENTS

| | | | |
|---|---|---|---|
| D. 220,877 | 6/1971 | Tigerman | 46/25 |
| D. 232,249 | 7/1974 | Markusen | D34/15 GG X |
| 572,701 | 12/1896 | Gebert | 273/157 R |
| 1,129,281 | 2/1915 | Dulgeroff | 46/24 UX |
| 1,621,178 | 3/1927 | Strub | 46/24 |
| 2,446,179 | 8/1948 | Harnquist | 46/25 |
| 2,549,189 | 4/1951 | Gabo | 35/72 X |
| 3,626,632 | 11/1971 | Bullock, Jr. | 46/25 |
| 3,863,918 | 2/1975 | Kramer | 46/25 X |
| 4,011,683 | 3/1977 | De Sousa | 46/25 |

FOREIGN PATENT DOCUMENTS

| | | | |
|---|---|---|---|
| 2238318 | 2/1973 | Fed. Rep. of Germany | 46/24 |
| 77699 | 2/1962 | France | 46/25 |

*Primary Examiner*—Louis G. Mancene
*Assistant Examiner*—Mickey Yu
*Attorney, Agent, or Firm*—Ancel W. Lewis, Jr.

[57] ABSTRACT

Construction elements have two oppositely arranged, connected body portions each having an external surface configuration disposed in the planes of a particular preselected triangular shape. Each body portion has three, outwardly converging, tapered projections with each having one of its projections cut off at a narrower end portion and the cut-off projections are connected together to provide four outwardly extending projections which serve as male connectors. Two adjacent projections extend in the same direction along spaced parallel planes and two projections are oppositely arranged to project out in generally opposite directions. An inwardly converging recess is formed between the adjacent projections which serves as a female connector to interfit with complementary male connectors. Each of the projections has two external contacting surface portions arranged in the planes of a particular preselected triangular shape with two sides having a selected length ratio, preferably a square root of two to one, to facilitate the assembly of the construction elements into a variety of assembled structures. The embodiments take the form of a solid block, hollowed block, strip material, or end-connected rod elements.

33 Claims, 24 Drawing Figures

CONSTRUCTION ELEMENTS AND ASSEMBLED STRUCTURES

FIELD OF THE INVENTION

This invention generally relates to construction elements and more particularly to construction elements for use in toy constructions or building constructions that contact and interfit with one another in a variety of ways.

BACKGROUND OF THE INVENTION

There has heretofore been provided a wide variety of construction elements that are readily assembled together to make up a variety of structures of different geometric configurations. Some construction elements have what is basically a ball and socket joint with snap-fit connections and others utilize what are basically rods or rods and cylinders that telescope one within another. In sets of these construction elements it is a frequent practice to have a number of differently shaped elements. While known prior art units are to some extent satisfactory, the present invention is believed to provide a number of advantages over known prior art.

Accordingly, it is an object of the present invention to provide a basic construction element that is simple, durable, attractive, and highly versatile.

Another object of the present invention is to provide a construction element that has wide versatility and flexibility in the manner of its assembly and interfitting with identical elements to make up a large number of variations of assembled structures.

Yet another object of the present invention is to provide a construction element that may be made of any required size but with selected dimensional and angle relationships and take the form of a solid block, hollowed block, or of strip material body and made of metal, wood, plastic or other suitable material.

Still a further object of the present invention is to provide a construction element characterized by having the external shape essentially that of a double triangle with the two triangles integrally connected at a tapered, cut-off projection of each to provide four tapered projections and a tapered recess with particular dimensional proportions and particular angular relationships that make the construction elements suitable for being made at about any scale for toy building blocks as well as larger sizes for building structures.

SUMMARY OF THE INVENTION

Construction elements and assembled structures of interfitted construction elements. Each element is comprised of a body having two generally triangular body portions that are oppositely arranged, alined, and connected at cut-off narrower end portions. Each body portion has tapered projections and a tapered recess with external contacting surface portions in the plane of a preselected triangular shape with a uniform width that is related to the height and side dimensions whereby the tapered projections and a recess of identical construction elements interfit in a variety of different ways. The construction elements take the form of a solid block, hollowed block, strip material, and end-connected rod elements to provide a high degree of versatility and flexibility.

Other objects, advantages and capabilities of the present invention will become more apparent as the description proceeds, taken in conjunction with the accompanying drawings in which like parts have similar reference numerals and in which.

Figure 1:
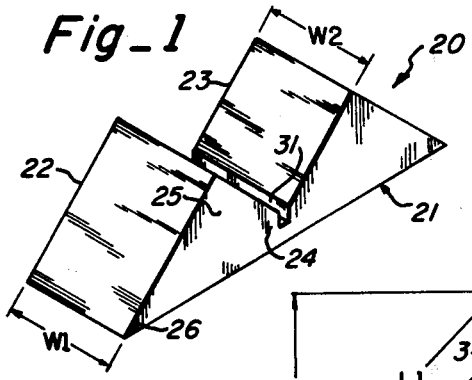
FIG. 1 is a perspective view of a solid, block-type construction element embodying features of the present invention.
Figure 2:
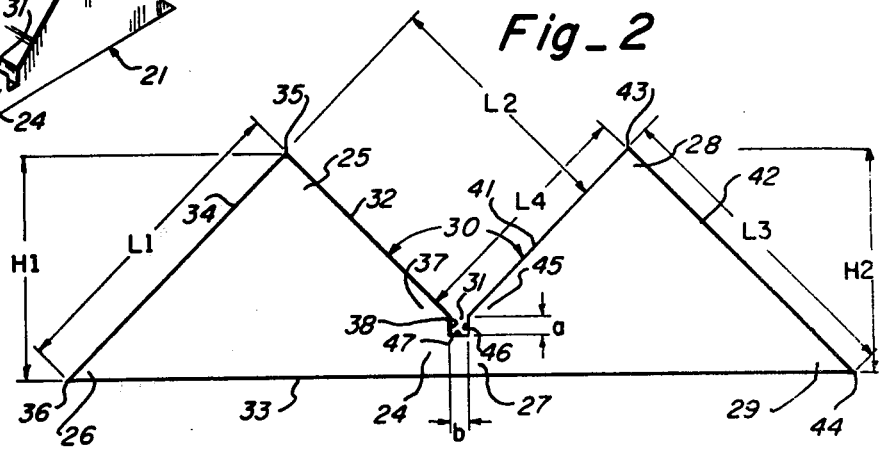
FIG. 2 is a side elevational view of the construction element illustrated in FIG. 1.
Figure 3:
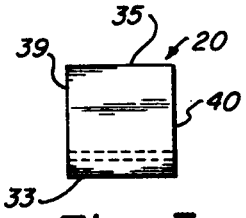
FIG. 3 is an end elevational view of the construction element of FIG. 1.

Referring to FIGS. 1 and 2 of the drawings, a solid block-type construction element designated by numeral 20 is shown to comprise a body 21 having two connected, juxtaposed body portions 22 and 23 each of a particular, preselected, generally triangular shape. In general, body portion 22 has three outwardly converging, tapered projections designated by numerals 24, 25 and 26 and body portion 23 has three outwardly converging, tapered projections designated by numerals 27, 28 and 29. Body portions 22 and 23 are arranged in alinement with one another and tapered projections 24 and 27 each have a cut-off or truncated narrower end portion, said narrower end portions being integrally connected together in a back-to-back relationship to provide four tapered projections that extend away from a central area of the body.

Projections 25 and 28 of the two body portions extend along spaced, parallel planes in the same direction and are herein referred to as adjacent projections. Projections 26 and 29 are arranged back-to-back to project out in opposite directions from a common central area of the body and are herein referred to as oppositely arranged projections. Projections 25 and 28 are adjacent to one another to form an inwardly converging tapered recess 30 that will serve as a female connector.

The body 21 is further provided with a slot 31 located in the central area of the body and is an extension or projection into the body from recess 30. The slot 31 shown in FIGS. 1 and 2 is generally channel-shaped and forms a female receiving socket sized to receive the projections 26 or 29 of a similar construction element, as described more fully hereinafter. It is understood, however, that the construction element may be utilized without the slot 31 with the tapered recess 30 coming to an inside point or vertex for some applications and some assembled structures.

In the solid block-type construction element shown in FIGS. 1 and 2, each of the angular projections has a smooth, flat, external contacting surface or surface portion that is in or defined by the plane of a preselected triangular shape and each tapered projection has one external surface portion common with another projection with no interruption or discontinuity thereof. In the hollowed block, sheet material, and rod-type construction elements described hereinafter, there is a discontinuity in the surfaces between the vertices of the preselected triangular shape, as described more fully hereinafter.

Referring first to body portion 22, tapered projection 24 has two external contact surface portions 32 and 33 that converge toward a vertex but a narrower end portion of projection 24 is cut off or truncated, and abuts against an adjacent cut-off or truncated, narrower end portion of projection 27, and these cut-off end portions of the two body portions are permanently affixed or formed together as one unitary body. Tapered projection 25 has two external surface portions 32 and 34 that converge toward and intersect at a vertex 35. Tapered projection 26 has two external surface portions 33 and 34 that converge toward and intersect at a vertex 45.

The body 21 with slot 31 provides what in effect is another external tapered projection 37 formed by external contacting surface portion 32, and an external contacting surface portion 38 is disposed perpendicular to external contacting surface portion 33 that forms one wall surface of slot 31.

Body portion 23 is of a corresponding size and shape with body portion 22 but is oppositely arranged or oppositely disposed. Tapered projection 27 has two external contact surface portions 33 and 41 that converge outwardly toward a vertex but with a narrower end portion cut off or truncated and affixed to truncated projection 24 of body portion 22 in an alined relationship as above described. Tapered projection 28 has two external surface portions 41 and 42 that converge toward and meet at a vertex 43. Tapered projection 29 has two external surface portions 42 and 33 that converge toward and meet at a vertex 44. A tapered projection 45 is formed on body portion 23 by external surface portion 41 and an external surface portion 46 arranged perpendicular to external surface portion 47 forming the base of the slot 31.

Each of the tapered projections 24, 25, 26, 27, 28 and 29 have external contact surface portions that are sized and arranged in relation to the planes of a preselected triangular shape with preselected side lengths and preselected angles and angular relationships between projections to provide four male tapered projections and a female tapered recess 30 defined by surface portions 32 and 41 that make the body especially suitable for joining and interfitting one construction element with another in a variety of assembled structures.

In the embodiment shown in FIGS. 1 and 2, the length of the oppositely arranged side of a preselected triangular shape of body portion 22, designated L1, to the length of the adjacent side of the preselected triangular shape of body portion 22 to the plane of adjacent side 41, designated L2, is of the ratio of the square root of two to one. Because of the corresponding size and shape of body portions 22 and 23, the length of the oppositely arranged side of the triangular shape of body portion 23, designated L3, to the length dimension between vertex 43 and the plane of the adjacent side 32, designated L4, is also the square root of two to one. The width of body portion 22 is designated W1 and preferably is equal to L2 and the width of body portion 23 is equal to L4 with L2 equal to L4. The height of the triangular shape of body portion 22 as is oriented in FIG. 2 is perpendicular to side 33 and bisecting vertex 35 is designated H1. This provides inside angles of 45° for projections 26 and 29, inside angles of 90° for projections 25 and 28, an angle of 90° for recess 30, and angles of 135° for projections 37 and 45.

Figure 4:
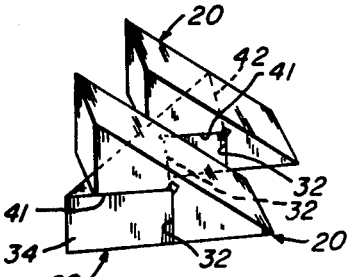
FIG. 4 is a perspective view of three identical construction elements assembled together with different external contact surface portions of two construction elements contacting different external contact surface portions of a third construction element.
Figure 5:
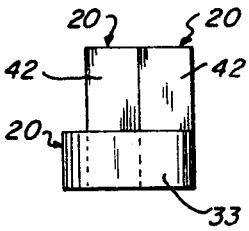
FIG. 5 is an end elevational view of the assembled construction elements of FIG. 4.

The lateral surfaces or surface portions of body 21 are parallel to one another and designated by numerals 39 and 40. The preferred width of W1 is uniform for the entire body 21 and is equal to L2 and L4, making contacting surface portions 32 and 41 of a square shape. This facilitates the assembly of two construction elements with one turned 90° relative to the other so that an adjacent contacting surface portion 32 of one element butts against an adjacent contacting surface portion 32 of another construction element. In addition, an adjacent contacting surface portion 32 of yet a third construction element 20 butts against an oppositely arranged external contacting surface portion 42 of the first construction element, as is illustrated in FIGS. 4 and 5.

Figure 6:
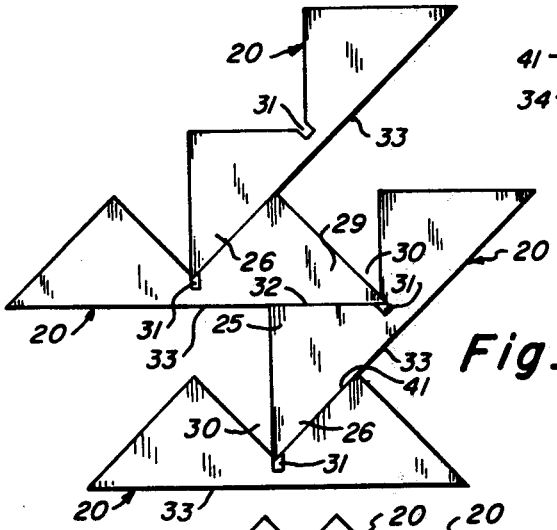
FIG. 6 is a side elevational view of an assembled structure made up of four identical construction elements showing a cantilever-type joint between connected construction elements.

The assembled structure shown in FIG. 6 has a first construction element 20 disposed with the common external contacting surface portion 33 disposed horizontally on a suitable support surface and its tapered recess 30 facing up. A second construction element 20 has its oppositely arranged tapered projection 26 inserted into the recess 30 and slot 31 of the first construction element 20 with surface portion 33 of the second construction element 20 seated on surface portion 41 of the first construction element in a cantilever-type joint. A third construction element 20 shown in FIG. 6 has its tapered projection 29 inserted into recess 30 and slot 31 of the second construction element 20 in a cantilever-type joint. A fourth constuction element 20 has its tapered projection 26 inserted into recess 30 and slot 31 of the third construction element in a cantilever-type joint. This positions the first and third construction elements parallel to one another and the second and fourth construction elements parallel to one another.

Figure 7:
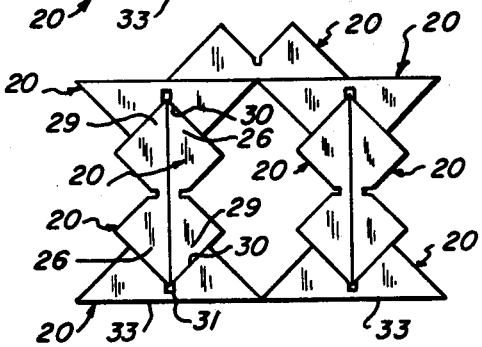
FIG. 7 is an elevational view of another assembled structure made up of nine identical construction elements.

The assembled structure shown in FIG. 7 uses a first construction element 20 with surface portion 33 thereof as a base supported on a supporting surface and recess 30 of the first construction element receives the projections 26 and 29 of upstanding second and third construction elements. A fourth construction element 20 has its recess 30 seated on the opposite end projections 29 and 26 of the upstanding second and third construction elements. A second similar assembly of four construction elements is arranged side-by-side to the first and a ninth construction element 20 rests on the fourth and eighth construction elements.

Figure 8:
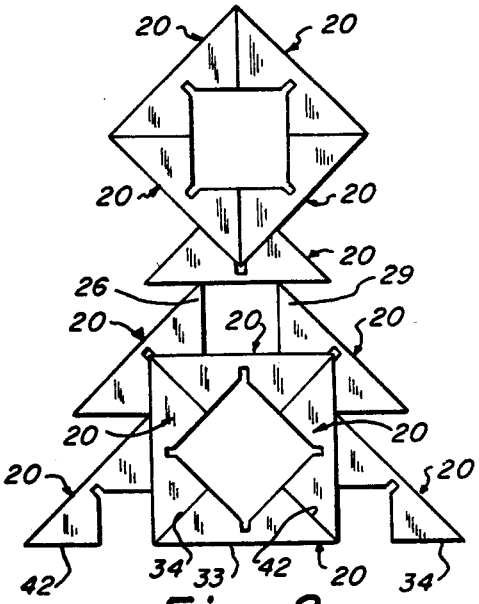
FIG. 8 is an elevational view of yet another assembled structure made up of thirteen identical construction elements.

The assembled structure shown in FIG. 8 has four construction elements 20 arranged with one of their oppositely arranged surface portions 34 and 42 of one abutting one of the oppositely arranged surface portions 34 and 42 of the other to make up a square configuration. One of the four construction elements has base surface portion 33 resting on a horizontal support surface and the upper corners of the square configuration are held by the positioning of recesses 30 of fifth and sixth construction elements 20 over the upper corner portions of the square configuration. Yet a seventh construction element 20 rests on the ends of projections 26 and 29 of the two corner holding construction elements and this in turn supports a square configuration of four more construction elements with the end projections inserted into the recess 30 of the seventh construction element. Two additional construction elements 20 are shown with oppositely arranged surface portions 34 and 42 down and disposed as side riggers to give further support to the sides of the first square configuration and to give added geometric effect.

Figure 9:
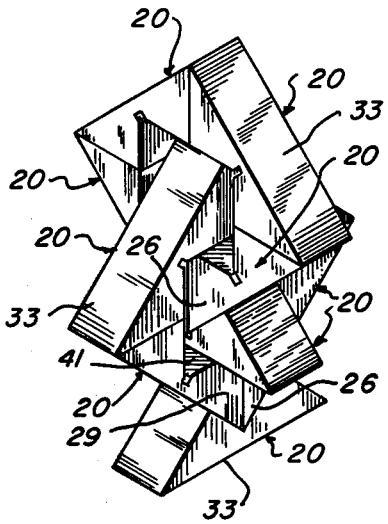
FIG. 9 is a perspective view of another assembled structure made up of ten identical construction elements.

In FIG. 9 the assembled structure shown has a construction element 20 with its tapered recess 30 facing up and receiving the tapered projections 26 and 29 of two of four construction elements arranged in a square configuration as above described. A sixth construction element has its base surface portion 33 turned 90° to the square configuration and resting on adjacent surface portions 41 and 32 of the two lower construction elements of the square configuration. A second square configuration of four more construction elements has the lower projections 26 and 29 inserted into the recess 30 and slot 31 of the fifth construction element so that the two square configurations are interlooped and turned at 90° to one another about a vertical axis.

Figure 10:
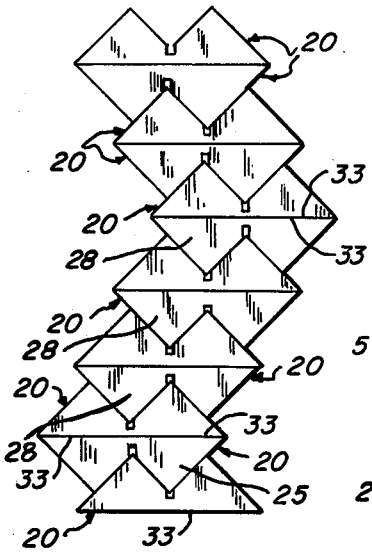
FIG. 10 is a side elevational view of yet another assembled structure of thirteen identical construction elements.

Referring now to FIG. 10, the assembled structure shown has a first construction element 20 with its base surface portion 33 down and a second construction element inverted so that tapered projection 25 thereof is inserted into the recess 30 of the first construction element 31. A third construction element has its base surface portion 33 seated on the base surface portion 33 of the third construction element. A fourth inverted construction element has its projection 28 inserted into the recess 30 of the third construction element and this is repeated in a zigzag fashion depending on which projection 25 or 28 is inserted into the up-facing recess of the supporting construction element 20.

Figure 11:
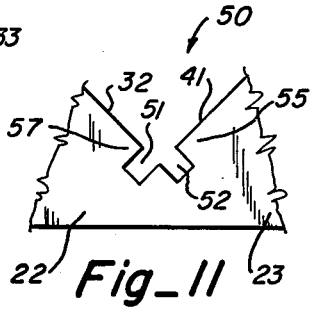
FIG. 11 is a fragmentary view of the central area of another form of solid, block-type construction element with a modified slot configuration.

In FIG. 11, construction element 50 with a modified slot structure has a slot 51 which is an extension of the plane of surface portion 41 a selected depth and width into the opposed body portion 22 and a slot 52 which is an extension of the plane of surface portion 32 of a selected width and depth into the opposed body portion 23 in a cross-slot arrangement. This provides a projection 57 in body portion 21 and a projection 55 in body portion 22 that have an inside right angle and a more pronounced undercut for the interlocking fit with the tapered projection of another construction element in a cantilever-type joint.

Figure 12:
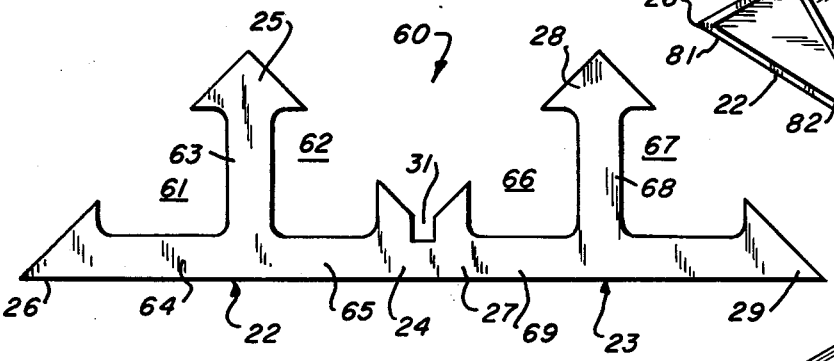
FIG. 12 is a side elevational view of a hollowed block-type construction element embodying features of the present invention.

Referring now to FIG. 12, the hollowed block-type construction element 60 shown has end projections 24 through 29. Each hss two external contacting surface portions in the planes of the same preselected triangular shape as in the form shown in FIGS. 1 and 2 and with a slot 31 in the central part. Body portion 22 has a hollowed area 61 extending into the body through surface portion 34 and a hollowed area 62 extending into the body through surface portion 32. In this construction the body has spoke-like arm portions 63, 64 and 65 arranged in an inverted T in the disposition shown in FIG. 12 for projections 25, 26 and 24, respectively. Projections 24, 25 and 26 are of a generally arrowhead shape. In a like manner body portion 23 has hollowed areas 66 and 67 together with spoke-like arm portions arranged as an inverted T. This configuration illustrates a construction wherein the external contacting surface portions are in the plane of, but not fully coextensive with, those of the preselected triangular shape.

Figure 14:
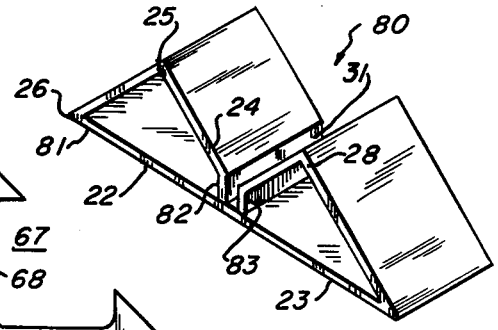
FIG. 14 is a perspective view of a strip material construction element embodying features of the present invention.
Figure 13:
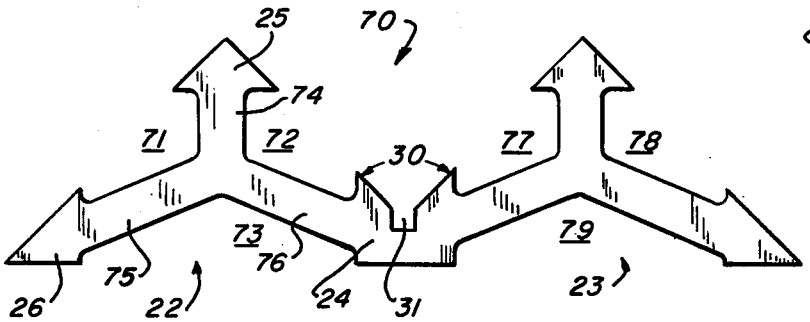
FIG. 13 is a side elevational view of another form of hollowed block-type construction element.

In FIG. 13, a modified form of hollowed block-type construction element 70 has the projections 24, 25 and 26 on body portion 22 and has hollowed areas 71, 72 and 73 in surface portions 34, 32 and 33, respectively, leaving spoke-like arm portions 74, 75 and 76 projecting out in a star-like manner from the center of the triangular shape of the projections. The projections again take the form of arrowhead shaped. Body portion 23 is modified with three similar hollowed areas to be symmetrical with body portion 22 but again is oppositely arranged.

in FIG. 14 there is shown a strip-material type construction element 80 constructed from a single strip of material 81 of uniform thickness and width such as a pliable metal that is shaped along its length into the double-triangular configuration as shown to provide the two juxtaposed body portions 22 and 23 and with tapered projections 24, 25, 26, 27, 28 and 29. In this form the end portions 82 and 83 of the strip material are bent in a parallel spaced relation to the ends and butt against the top of a base section to form the slot 31. The edge surface portions 39 and 40 in this form are of a limited width that follows the contour of the body. This configuration can also be made of an extruded plastic material.

Figure 15:
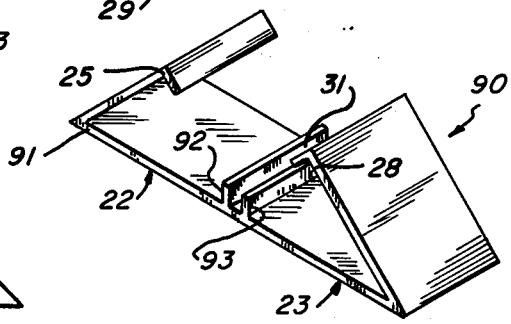
FIG. 15 is a perspective view of another form of strip material construction element.

In a modified form of strip-material type construction that is shown in FIG. 15, a strip of material 91 is formed in the double-triangle shape as with element 80 above described but is terminated after forming the vertices of projections 25 and 28. Parallel, spaced, vertical strips 92 and 93 are mounted on the base portion to form the slot 31. This configuration would be best made of extruded plastic material.

Figure 16:
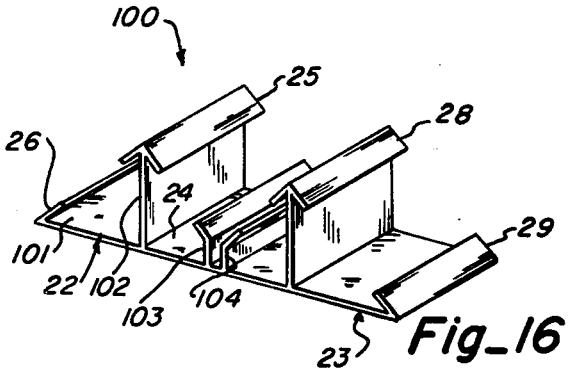
FIG. 16 is a perspective view of another form of strip material construction element.

Yet another form of strip-material type construction element 100 is shown in FIG. 16. In this form one strip of material 101 is turned at the ends to form the end projections 26 and 29. For body portion 22 an upright strip of material 102 supports a V-shaped vertex strip of material forming projection 25 while body portion 23 has a similar arrangement forming projection 28. A pair of upwardly and outwardly extending flanges 103 and 104 form the slot 31.

Figure 18:
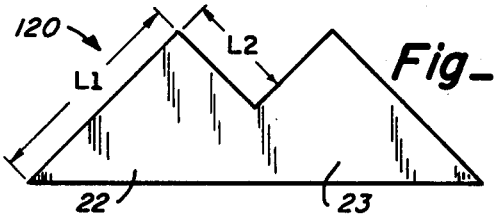
FIG. 18 is a side elevational view of another modified solid block-type construction element.

Referring now to FIGS. 17–21, there are shown some variations and modifications in the shape of the construction elements that are suitable for some applications. The solid block-type construction element 110 in FIG. 17 has a ratio of L1 to L2 of 1.618 to one. In FIG. 18 the construction element 120 has a ratio of L1 to L2 of two to one. The construction element 130 in FIG. 19 has a ratio of L1 to L2 of the square root of six to one. In each of elements 110, 120 and 130 the right angle projections and right angle recess is retained, but the depth of the recess is less. Moreover, the two body portions 22 and 23 of each of these construction elements are of a corresponding size and shape so that the length dimensions L3 and L4 would follow the same ratio as L1 and L2.

Figure 20:
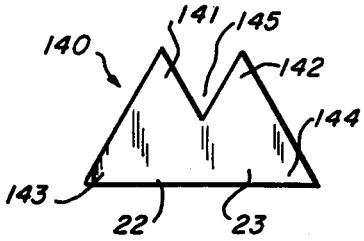
FIG. 20 is a side elevational view of another modified solid block-type construction element.
Figure 21:
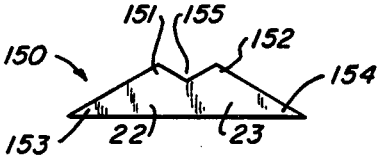
FIG. 21 is a side elevational view of another modified solid block-type construction element.

The construction element 140 shown in FIG. 20 has adjacent projections 141 and 142 with an acute inside angle and oppositely arranged projections 143 and 144 at obtuse inside angles. The tapered recess 145 is disposed at an acute angle. Another variation has a construction element 150 shown in FIG. 21 with adjacent projections 151 and 152 having obtuse inside angles and oppositely arranged projections 153 and 154 having acute inside angles with recess 155 being disposed at an obtuse angle.

Figure 22:
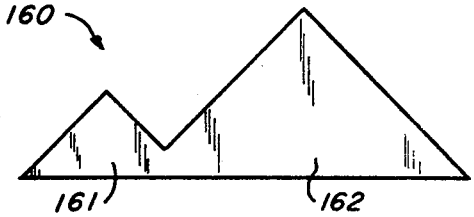
FIG. 22 is a side elevational view of another modified solid block-type construction element.
Figure 17:
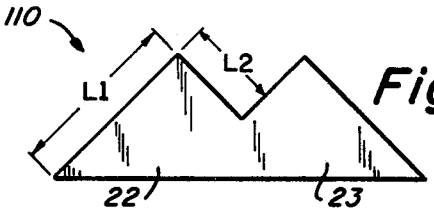
FIG. 17 is a side elevational view of a modified solid block-type construction element.

Another form of solid block-type construction element 160 shown in FIG. 22 has one generally triangular body portion 161 of approximately half the size of an adjacent generally triangular body portion 162 to provide a construction element having two generally triangular body portions of unequal size.

Figure 23:
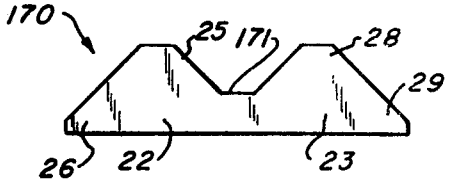
FIG. 23 is a side elevational view of a modified solid block-type construction element.

Still another form of solid body-type construction element 170 shown in FIG. 23 has each of the tapered projections 25, 26, 28 and 29 cut off or truncated and the tapered recess 30 filled to provide a surface 171 arranged so that the ends of the two cut-off projections 26 and 29 of two other construction elements disposed therein will fit flush against surface 171.

Figure 24:
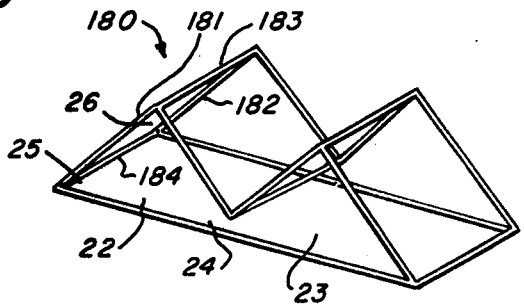
FIG. 24 is a perspective view of a rod-type construction element embodying features of the present invention.
Figure 19:
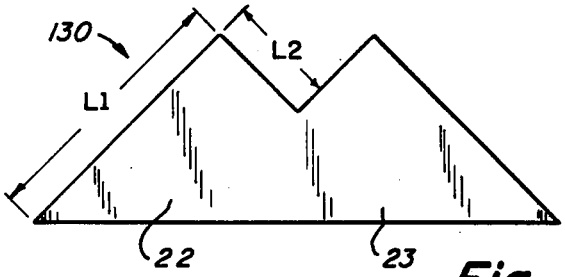
FIG. 19 is a side elevational view of another modified solid block-type construction element.

A rod-type construction element 180 shown in FIG. 24 is made of an assembly of end-connected rods or rod-like elements with each at a corner of the body portions 22 and 23. For example, a pair of spaced parallel rods such as side rods 181 and 182 are connected at the ends to cross rods 183 and 184 at the vertices 35 and 36, respectively, for defining an area corresponding to surface 34 in FIG. 24. This construction, of course, is of considerably less weight and requires less material.

By way of illustration, but not by way of limitation, a preferred construction element for use as a toy block has the following dimensions for two sizes of toy blocks:

| ¾ inch size | 1½ inch size |
|---|---|
| W1 = W2 = 0.75 inches | 1.5 inches |
| a = b = 0.625 inches | 0.125 inches |
| L1 = L3 = 1.06 inches | 2.12 inches |

These toy blocks may be made of plastic, wood or aluminum. Suitable plastics are polypropylene or polyethylene that is injection-molded in bright colors. Suitable wood is walnut, rosewood, pine or maple. The aluminum may be solid, hollow or extruded with bright colors.

Although the present invention has been described with a certain degree of particularity, it is understood that the present disclosure has been made by way of example and that changes in details of structure may be made without departing from the spirit thereof.

What is claimed is:

1. A construction element comprising:

a body having first and second symmetrically arranged body portions of a corresponding shape, said first and second body portions being mirror images on opposite sides of a dividing line, and having common sides connected end-to-end to form a common side and common base for said body, each of said body portions having three projections with each of said projections having two external surface portions in the planes of two sides of a preselected triangular shape, one projection of each of said body portions being cut off at the end and the cut-off projections joined together to provide two adjacent projections that extend in the same direction along spaced parallel planes, a recess between said adjacent projections, and two oppositely arranged projections so that said body has the form of two triangular shapes with overlapping projections, two adjacent sides of the two triangular shapes intersecting above two common sides and two oppositely arranged sides, the length of said two adjacent sides being equal, the length of each oppositely arranged side to the length of an adjacent side of each triangular shape of each of said bodies being of a selected ratio of a number greater than one to one.

2. A construction element as set forth in claim 1 wherein said selected ratio is substantially the square root of a whole number greater than one to one.

3. A construction element as set forth in claim 1 wherein said selected ratio is substantially the square root of two to one.

4. A construction element as set forth in claim 1 wherein said selected ratio is substantially 1.618 to one.

5. A construction element as set forth in claim 1 wherein said selected ratio is substantially the square root of six to one.

6. A construction element as set forth in claim 1 wherein each adjacent projection of each of said first and second body portions and said recess has two external contacting surface portions disposed in planes arranged at a right angle.

7. A construction element as set forth in claim 1 wherein each adjacent projection of each of said first and second body portions has two external contacting surface portions disposed in planes arranged at an acute inside angle.

8. A construction elements as set forth in claim 1 wherein each adjacent projection of each of said first and second body portions has two external contacting surface portions disposed in planes arranged at an obtuse inside angle.

9. A construction element as set forth in claim 1 wherein each adjacent projection of each of said first and second body portions has two external contacting surface portions disposed in planes arranged at a 45-degree inside angle.

10. A construction element as set forth in claim 1 wherein said body is substantially solid and each of two of the three tapered projections of each of said first and second body portions meet at a vertex.

11. A construction element as set forth in claim 1 wherein said body is formed of rod-like members connected at the ends to conform to said preselected triangular shape.

12. A construction element as set forth in claim 1 wherein said first and second body portions are of unequal size.

13. A construction element as set forth in claim 1 wherein said body is hollowed between at least two sets of said tapered projections.

14. A construction element as set forth in claim 13 wherein said projections are of a generally arrowhead shape.

15. A construction element as set forth in claim 14 wherein said projections are supported on a generally T-shaped spoke-like arm portion.

16. A construction element as set forth in claim 14 wherein said projections are supported on generally star-shaped spoke-like arm portions radiating out from the center of the associated preselected triangular shape.

17. A construction element as set forth in claim 1 wherein said body is formed of a length of strip material of a substantially uniform thickness throughout its length that is shaped along its length to follow said preselected triangular shape.

18. A construction element as set forth in claim 17 wherein said length of strip material is shaped at the ends to form a slot adapted to receive a similar construction element in a cantilever-type joint, said slot projecting inwardly into each of said body portions along said recess at the joint connecting said cut-off end portions.

19. A construction element as set forth in claim 17 wherein said length of strip material is shaped along its length to form two of the three projections of each of said body portions and a channel-shaped portion forms a slot to define the extremities of a third tapered projection, said slot projecting inwardly into each of said body portions along said recess at the joint connecting said cut-off end portions.

20. A construction element as set forth in claim 17 wherein a first length of strip material is shaped about its length to form one of the three projections of each of said body portions and a second upright strip of material terminates in a V-shaped portion to form the second projection with an upwardly and outwardly projecting portion defining with said first length of strip material said third projection and a receiving slot, said slot projecting inwardly into each of said body portions along said recess at the joint connecting said cut-off end portions.

21. An assembled structure comprising:

a plurality of interfitting construction elements, said construction elements including a body having first and second symmetrically arranged body portions of a corresponding shape and having common sides connected end-to-end to form a common side and common base for said body, said first and second body portions being mirror images on opposite sides of a dividing line, each of said body portions having three projections with each of said projections having two external surface portions in the planes of two sides of a preselected triangular shape, one projection of each of said body portions being cut off at the end and the cut-off projections joined together to provide two adjacent projections that extend in the same direction along spaced parallel planes, a recess between said adjacent projections, and two oppositely arranged projections so that said body has the form of two triangular shaped with overlapping projections, two adjacent sides of the two triangular shaped intersecting above two common sides and two oppositely arranged sides, the length of said two adjacent sides being equal, the length of each oppositely arranged side to the length of an adjacent side of each triangular shape of each of said bodies being of a selected ratio of a number greater than one to one, a first and a second of said construction elements being arranged with an adjacent side portions of one of said adjacent projections of said first construction element contacting an adjacent side portion of one of said adjacent projections of said second construction element.

22. An assembled structure as set forth in claim 21 including a third construction element interfitted with said first construction element arranged with a side portion of one of said adjacent projections of said third construction element contacting a side portion of one of said oppositely arranged projections of said first construction element.

23. An assembled structure comprising:

a plurality of construction elements each including a body having first and second symmetrically arranged body portions of a corresponding shape and having common sides connected end-to-end to form a common side and common base for said body, said first and second body portions being mirror images on opposite sides of a dividing line, each of said body portions having three projections with each of said projections having two external surface portions in the planes of two sides of a preselected triangular shape, one projection of each of said body portions being cut off at the end and the cut-off projections joined together to provide two adjacent projections that extend in the same direction along spaced parallel planes, a recess between said adjacent projections, and two oppositely arranged projections so that said body has the form of two triangular shapes with overlapping projections, two adjacent sides of the two triangular shapes intersecting above two common sides and two oppositely arranged sides, the length of said two adjacent sides being equal, the length of each oppositely arranged side to the length of an adjacent side of each triangular shape of each of said bodies being of a selected ratio of a number greater than one to one, a set of four of said construction elements being arranged with the oppositely arranged tapered projections abutting one another to form a square configuration.

24. An assembled structure as set forth in claim 23 including a fifth construction element having the tapered recess thereof fitted over at least one corner of said square configuration.

25. An assembled structure as set forth in claim 23 including a second set of four construction elements arranged in a square configuration interlooped with the first-mentioned set of construction elements in a square configuration.

26. An assembled structure comprising:

a plurality of construction elements each including a body having first and second symmetrically arranged body portions of a corresponding shape and having common sides connected end-to-end to form a common side and common base for said body, said first and second body portions being mirror images on opposite sides of a dividing line, each of said body portions having three projections with each of said projections having two external surface portions in the planes of two sides of a preselected triangular shape, one projection of each of said body portions being cut off at the end and the cut-off projections joined together to provide two adjacent projections, a recess between said adjacent projections that extends in the same direction along spaced parallel planes, and two oppositely arranged projections so that said body has the form of two triangular shapes with overlapping projections, two adjacent sides of the two triangular shaped intersecting above two common sides and two oppositely arranged sides, the length of said two adjacent sides being equal, the length of each oppositely arranged side to the length of an adjacent side of each triangular shape of each of said bodies being of a selected ratio of a number greater than one-to-one, a first and said construction elements and a second of said construction elements interfitted together having one of the adjacent projections of said second construction element inserted into the recess of said first construction element.

27. An assembled structure as set forth in claim 26 including a third construction element supported in a back-to-back relationship on said second construction element to receive one of the adjacent tapered projections of a fourth construction element.

28. A construction element comprising:

a body having first and second body portions, each body portion having a plurality of projections, each of said body portions having a projection with a cut-off end portion, said cut-off end portions being joined together to provide two adjacent projections, a recess formed between said adjacent projections, and two oppositely arranged projections, said body having a slot projecting inwardly into each of said body portions along said recess at the joint connecting said cut-off end portions, said slot being sized to receive a projection of a similar construction element in a cantilever-type joint between two similar construction elements.

29. A construction element as set forth in claim 28 wherein said slot is defined by parallel, spaced side wall surface portions defining a pair of opposed projections in said body each having an obtuse inside angle.

30. A three-dimensional construction element capable of interfitting with a second identical construction element comprising:

a body having first and second body portions each of a generally triangular shape with each having first, second and third outwardly converging projections, each of said projections having two external contacting surface portions arranged in the planes of two sides of a preselected triangular shape, each of said body portions being of a corresponding size and having a projection with a cut-off narrower end portions, said cut-off narrower end portions being integrally joined together to provide two adjacent projections that extend in the same direction along spaced parallel planes with adjacent sides providing an inwardly converging recess and two oppositely arranged projections that extend out in opposite directions from a central area of said body so that said body has the form of two triangular shapes with overlapping projections, two adjacent sides of the two triangular shapes intersecting above two common sides and two oppositely arranged side, said two common sides being coplanar and forming a common base side for said body, said preselected triangular shape having two sides with the length ratio of the square root of two-to-one, two inside angles of substantially 45° and an inside angle of substantially 90°, the width of said body being substantially uniform, the width, height and distance along each adjacent side being of substantially the same dimensions, and a slot in said central area sized to recieve at least one tapered projection of an identical construction element in a cantilever-type joint.

31. An assembled structure comprising:

a plurality of interfitting construction elements, each said construction element including a body having first and second body portions, each body portion having a plurality of projections, each of said body portions having a projection with a cut-off end portion, said cut-off end portions being joined together to provide two adjacent projections, a recess formed between said adjacent projections, and two oppositely arranged projections, said body having a slot projecting inwardly from said recess, a first of said interfitting construction elements having one of the oppositely arranged projections inserted into the recess and slot of a second construction element and supported on a surface portion of said second construction element defining said recess in a cantilever-type joint.

32. An assembled structure comprising:

a plurality of interfitting construction elements, each said construction element including a body having first and second symmetrically arranged body portions of a corresponding shape and having common sides connected. end-to-end to form a common side and common base for said body, said first and second body portions being mirror images on opposite sides of a dividing line, each of said body portions having three projections with each of said projections having two external surface portions in the planes of two sides of a preselected triangular shape, one projection of each of said body portions being cut off at the end and the cut-off projections joined together to provide two adjacent projections that extend in the same direction along spaced parallel planes, a recess between said adjacent projections, and two oppositely arranged projections so that said body has the form of two triangular shapes with overlapping projections, two adjacent sides of the two triangular shapes intersecting above two common sides and two oppositely arranged sides, the length of said two adjacent sides being equal, the length of each oppositely arranged side to the length of an adjacent side of each triangular shape of each of said bodies being of a selected ratio of a number greater than one to one, a first of said construction elements interfitting with a second and a third of said construction elements, said second and third construction elements having one oppositely arranged projection arranged back-to-back and inserted into the recess of said first construction element.

33. A construction element comprising:

a body having first and second body portions, each body portion having a plurality of projections, each of said body portions having a projection with a cut-off end portion, said cut-off end portions being joined together to provide two adjacent projections, a recess formed between said adjacent projections, and two oppositely arranged projections, said body having a slot projecting inwardly into each of said body portions along said recess, said slot in each of said body portions being an extension of the plane of an adjacent surface portion of one body portion into the other of said body portions.

* * * * *